US012345434B2

(12) United States Patent
Yamada et al.

(10) Patent No.: US 12,345,434 B2
(45) Date of Patent: Jul. 1, 2025

(54) AIR CONDITIONING SYSTEM

(71) Applicant: DAIKIN INDUSTRIES, LTD., Osaka (JP)

(72) Inventors: Miki Yamada, Osaka (JP); Junichi Shimoda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 501 days.

(21) Appl. No.: 17/266,189

(22) PCT Filed: Aug. 6, 2018

(86) PCT No.: PCT/JP2018/029417
§ 371 (c)(1),
(2) Date: Feb. 5, 2021

(87) PCT Pub. No.: WO2020/031234
PCT Pub. Date: Feb. 13, 2020

(65) Prior Publication Data

US 2021/0302051 A1 Sep. 30, 2021

(51) Int. Cl.
*F24F 11/65* (2018.01)
*F24F 11/36* (2018.01)
*F25B 49/02* (2006.01)

(52) U.S. Cl.
CPC ..... *F24F 11/65* (2018.01); *F24F 11/36* (2018.01); *F25B 49/02* (2013.01)

(58) Field of Classification Search
CPC .. F24F 11/65; F24F 11/36; F24F 11/32; F25B 49/02; F25B 2500/222; F25B 2500/02; F25B 25/005
See application file for complete search history.

(56) References Cited

U.S. PATENT DOCUMENTS

2015/0090803 A1* 4/2015 Okamoto ..... F24D 19/1087 165/294
2015/0219343 A1* 8/2015 Moriwaki ..... F24D 5/12 62/236

(Continued)

FOREIGN PATENT DOCUMENTS

JP 64-54160 A 3/1989
JP 2015-145758 A 8/2015

(Continued)

OTHER PUBLICATIONS

"Why does Aux Heat (auxiliary heat) light keep coming on at my thermostat, even when it's not that cold outside?" (Year: 2018).*

(Continued)

*Primary Examiner* — Frantz F Jules
*Assistant Examiner* — Devon Moore
(74) *Attorney, Agent, or Firm* — Birch, Stewart, Kolasch & Birch, LLP

(57) ABSTRACT

An air conditioning system (1) has: a heat pump unit (60) that heats a room with a vapor compression refrigerant circuit (20); a separate heat source unit (70) that heats a room with a heat source separate from the heat pump unit (60); and a control unit (8) that controls an operation of the heat pump unit (60) and the separate heat source unit (70). As a refrigerant, a flammable refrigerant is sealed in the refrigerant circuit (20). When the flammable refrigerant is leaking, the control unit (8) heats the room with the separate heat source unit (70) in both cases where a heat pump heating condition is satisfied and where a separate heat source heating condition is satisfied.

4 Claims, 7 Drawing Sheets

(56) References Cited

U.S. PATENT DOCUMENTS

| | | | | |
|---|---|---|---|---|
| 2016/0129757 | A1 | 5/2016 | Kodera et al. | |
| 2016/0334115 | A1* | 11/2016 | Kojima | F24D 19/1087 |
| 2017/0343258 | A1* | 11/2017 | Yamaguchi | F24F 13/222 |
| 2019/0170385 | A1* | 6/2019 | Maddox | F24F 11/72 |

FOREIGN PATENT DOCUMENTS

| | | | |
|---|---|---|---|
| WO | WO 2015/011920 | A1 | 1/2015 |
| WO | WO 2016/151642 | A1 | 9/2016 |

OTHER PUBLICATIONS

WO 2016151642 English translation (Year: 2016).*
International Preliminary Report on Patentability and English translation of the Written Opinion of the International Searching Authority for International Application No. PCT/JP2018/029417, dated Feb. 18, 2021.
International Search Report issued in PCT/JP2018/029417 (PCT/ISA/210), dated Oct. 23, 2018.

* cited by examiner

AIR CONDITIONING SYSTEM

TECHNICAL FIELD

An air conditioning system having: a heat pump unit that heats a room with a vapor compression refrigerant circuit; and a separate heat source unit that heats a room with a heat source separate from the heat pump unit.

BACKGROUND ART

Conventionally, there is an air conditioning system having a heat pump unit that heats a room with a vapor compression refrigerant circuit, and a separate heat source unit that heats a room with a furnace (a heat source separate from the heat pump unit). As such an air conditioning system, as shown in Patent Literature 1 (JP S64-54160 A), there is a system that switches between heating with a heat pump unit and heating with a separate heat source unit. That is, this air conditioning system performs heating with the heat pump unit when a condition for heating with the heat pump unit is satisfied, and performs heating with the separate heat source unit when a condition for heating with the separate heat source is satisfied.

SUMMARY OF THE INVENTION

In the conventional air conditioning system described above, in a case where a flammable refrigerant is used as a refrigerant sealed in the refrigerant circuit, when the flammable refrigerant leaks from the refrigerant circuit, it is necessary to limit the use of the heat pump unit. This disables heating of the room with the heat pump unit.

This inhibits the heating itself of the room if the flammable refrigerant is leaking even though the condition for heating with the heat pump unit is satisfied, which may impair comfort of a person in the room.

An air conditioning system according to a first aspect includes: a heat pump unit that heats a room with a refrigerant circuit of vapor compression; a separate heat source unit that heats a room with a heat source separate from the heat pump unit; and a control unit that controls an operation of the heat pump unit and the separate heat source unit. In the refrigerant circuit, a flammable refrigerant is sealed as the refrigerant. When a flammable refrigerant is not leaking, the control unit heats the room with the heat pump unit in a case where a heat pump heating condition is satisfied, and heats the room with the separate heat source unit in a case where a separate heat source heating condition is satisfied. In addition, when the flammable refrigerant is leaking, the control unit heats the room with the separate heat source unit in both cases where the heat pump heating condition is satisfied and where the separate heat source heating condition is satisfied.

As a result, here, the room is heated by the separate heat source unit even if the heat pump heating condition is satisfied, when the flammable refrigerant is leaking. Therefore, it is possible to avoid a case where the heating itself of the room is inhibited, and prevent impairment of comfort of a person in the room.

An air conditioning system according to a second aspect is the air conditioning system according to the first aspect, in which the control unit determines whether the heat pump heating condition or the separate heat source heating condition is satisfied, based on an outside air temperature or an indoor load.

This allows, here, the room to be heated by the separate heat source unit, even if the outside air temperature or the indoor load satisfies the heat pump heating condition, when the flammable refrigerant is leaking.

An air conditioning system according to a third aspect is the air conditioning system according to the first or second aspect, in which the separate heat source unit has a furnace that heats air to be sent into the room by burning fuel.

This allows, here, the room to be heated by the furnace in a case where the separate heat source heating condition is satisfied, when the flammable refrigerant is not leaking, and the room to be heated by the furnace in both cases where the heat pump heating condition is satisfied and where the separate heat source heating condition is satisfied, when flammable refrigerant is leaking.

An air conditioning system according to a fourth aspect has a refrigerant sensor that detects a flammable refrigerant, in the air conditioning system according to any one of the first to third aspects.

This enables, here, detection as to whether or not a flammable refrigerant is leaking by using the refrigerant sensor.

DESCRIPTION OF EMBODIMENTS

Hereinafter, an air conditioning system will be described with reference to the drawings.

(1) Configuration

<Overall>

Figure 1:
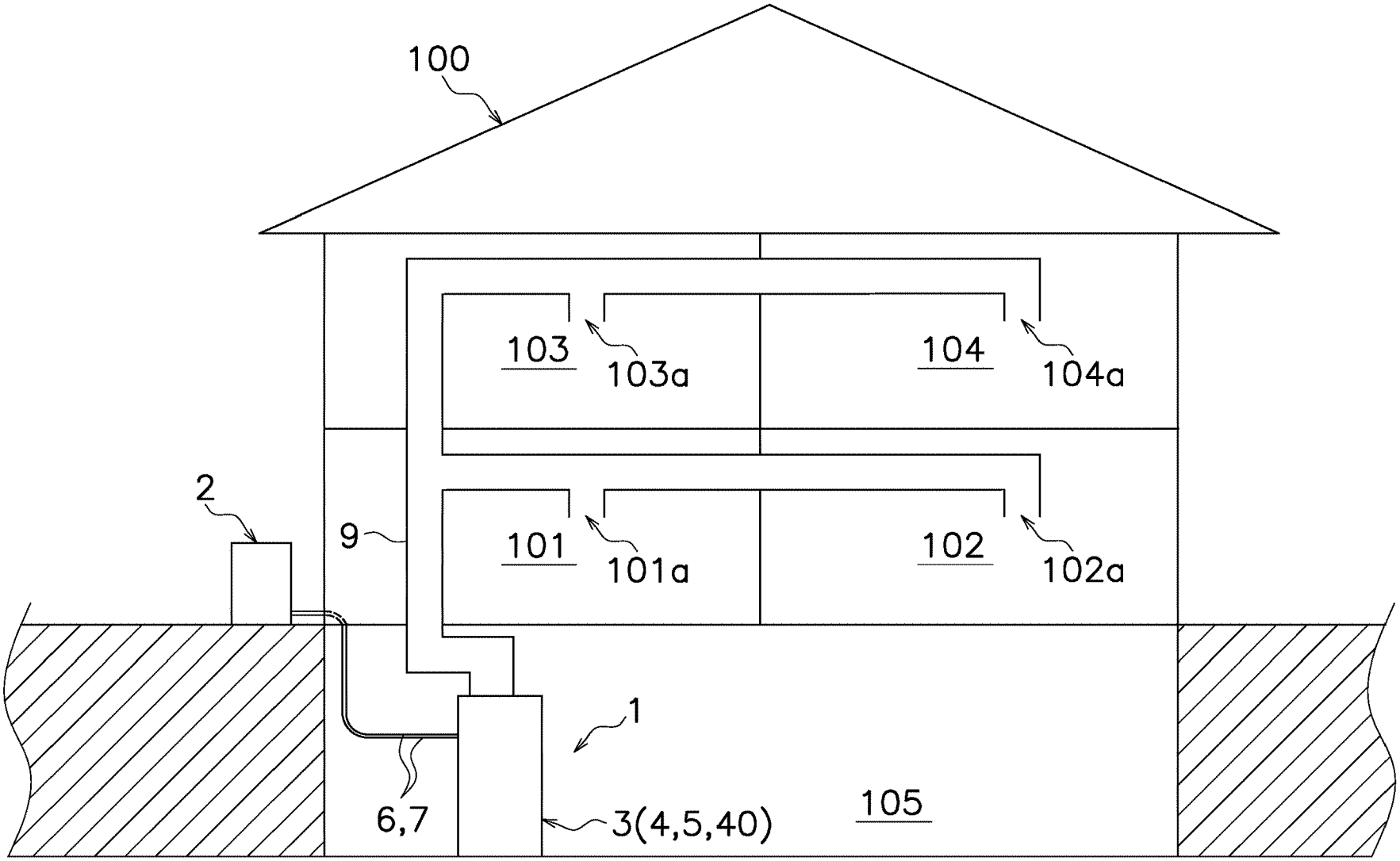
FIG. 1 is an exemplary view showing an arrangement of an air conditioning system according to an embodiment.
Figure 2:
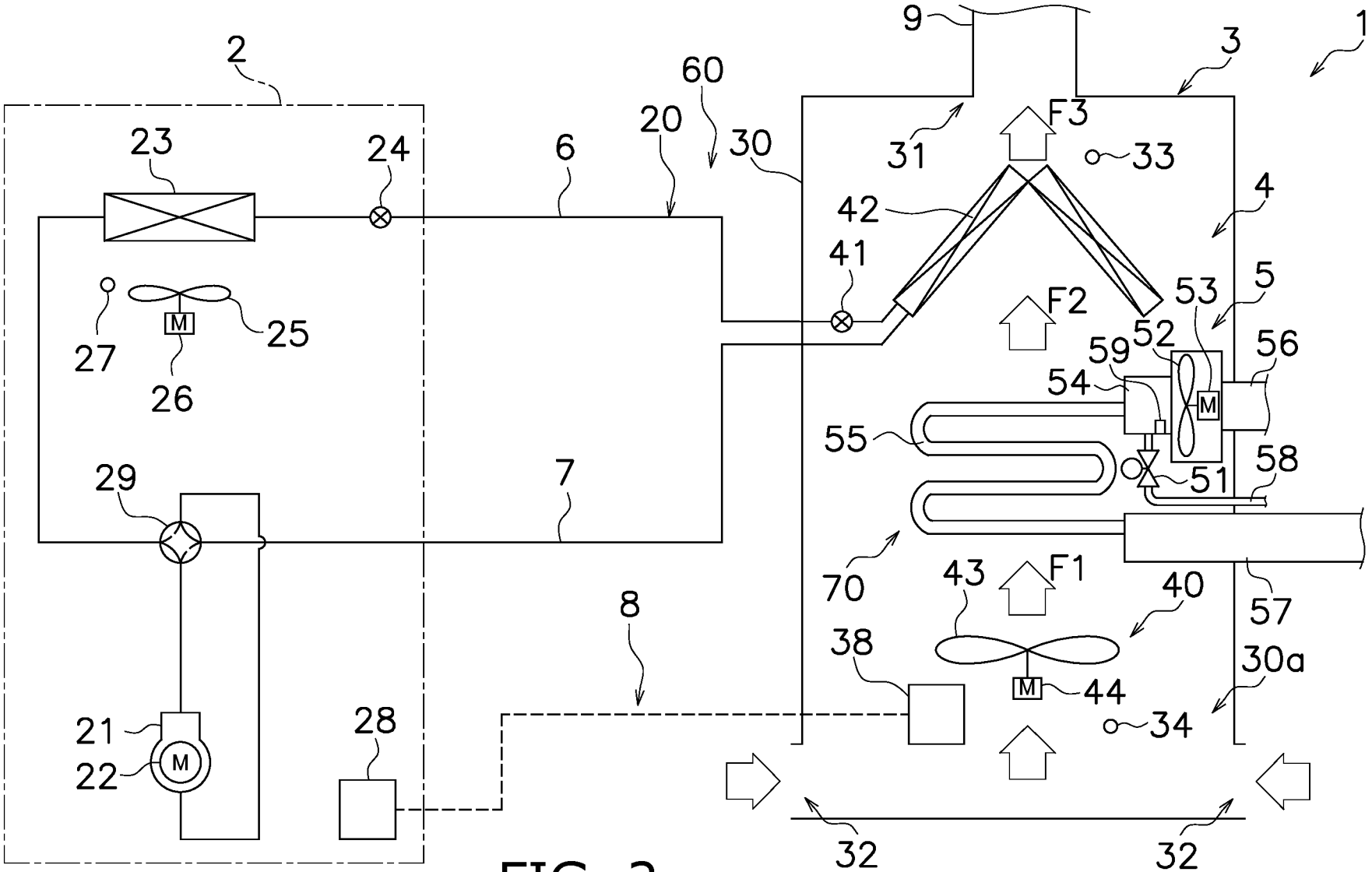
FIG. 2 is a schematic configuration diagram of the air conditioning system.

FIG. 1 is an exemplary view showing an arrangement of an air conditioning system 1 according to an embodiment. FIG. 2 is a schematic configuration diagram of the air conditioning system 1.

The air conditioning system 1 is a device used for air conditioning of houses or buildings. Here, the air conditioning system 1 is installed in a two-story house 100. In the house 100, rooms 101 and 102 are provided on the first floor, and rooms 103 and 104 are provided on the second floor. In addition, the house 100 is provided with a basement 105. Note that the house or the building in which the air conditioning system 1 is installed is not limited to a structure shown in FIG. 1, and may have another structure.

The air conditioning system 1 is a so-called duct air conditioning system. The air conditioning system 1 mainly includes: an outdoor unit 2; a utilization unit 3; refrigerant connection pipes 6 and 7 that connect the outdoor unit 2 and the utilization unit 3; and an air-blowing duct 9 that sends air that has been air-conditioned by the utilization unit 3, to rooms 101 to 104. The air-blowing duct 9 is branched into the rooms 101 to 104, and is connected to ventilation ports 101*a* to 104*a* of the respective rooms 101 to 104.

Here, the outdoor unit 2, an indoor unit 4 that is a part of the utilization unit 3, and the refrigerant connection pipes 6 and 7 constitute a heat pump unit 60 that heats the room with a vapor compression refrigerant circuit 20. Further, a furnace unit 5 (a furnace), which is apart of the utilization unit 3, constitutes a separate heat source unit 70 that heats the room with a heat source (here, heat generated by combustion of fuel) separate from the heat pump unit 60. As described above, here, the utilization unit 3 has both the indoor unit 4 constituting the heat pump unit 60 and the furnace unit 5 constituting the separate heat source unit 70. In addition, the utilization unit 3 has an indoor fan 40 that takes in air in the rooms 101 to 104 into a housing of the utilization unit 3, and sends air that has been air-conditioned by the heat pump unit 60 (the indoor unit 4) and the separate heat source unit 70 (the furnace unit 5) into the rooms 101 to 104.

<Heat Pump Unit>

As described above, the heat pump unit 60 includes the outdoor unit 2, the indoor unit 4 that is a part of the utilization unit 3, and the refrigerant connection pipes 6 and 7. Here, the outdoor unit 2 and the indoor unit 4 are connected to each other via the refrigerant connection pipes 6 and 7. That is, the refrigerant circuit 20 of the heat pump unit 60 is configured by connecting the outdoor unit 2 and the indoor unit 4 via the refrigerant connection pipes 6 and 7. Here, the refrigerant connection pipes 6 and 7 are refrigerant pipes constructed on-site when the air conditioning system 1 is installed. Further, the refrigerant circuit 20 is filled with a refrigerant (hereinafter, referred to as a "flammable refrigerant") that may ignite under specific conditions, such as R32, as a refrigerant.

Here, the indoor unit 4 is provided in the housing 30 of the utilization unit 3 installed in a basement 105 of the house 100. The indoor unit 4 is connected to the outdoor unit 2 via the refrigerant connection pipes 6 and 7, and forms a part of the refrigerant circuit 20. Note that the utilization unit 3 may be provided in a place other than the basement 105.

The indoor unit 4 mainly includes: an indoor expansion valve 41; and an indoor heat exchanger 42 (a refrigerant heat exchanger) that heats air by heat radiation from the flammable refrigerant in the refrigeration cycle during a heat pump heating operation (described later). The indoor expansion valve 41 is a valve that decompresses the flammable refrigerant circulating in the refrigerant circuit 20, and adjusts a flow rate of the flammable refrigerant flowing through the indoor heat exchanger 42 as the refrigerant heat exchanger. Here, the indoor heat exchanger 42 is arranged on a most leeward side (a most downstream side with respect to a flow direction of air in the air-blowing flow path 30*a*), in the air-blowing flow path 30*a* from an air inflow port 32 to an air outflow port 31 formed in the housing 30 of the utilization unit 3.

The outdoor unit 2 is installed outside of the house 100. The outdoor unit 2 is connected to the indoor unit 4 via the refrigerant connection pipes 6 and 7, and forms a part of the refrigerant circuit 20.

The outdoor unit 2 mainly has a compressor 21, an outdoor heat exchanger 23, an outdoor expansion valve 24, and a four-way switching valve 29. The compressor 21 has a compression element (not illustrated) that compresses a flammable refrigerant, and a compressor motor 22 that rotationally drives the compression element. The outdoor heat exchanger 23 is a heat exchanger that evaporates the flammable refrigerant in the refrigeration cycle with outdoor air, during the heat pump heating operation. Near the outdoor heat exchanger 23, an outdoor fan 25 that sends outdoor air to the outdoor heat exchanger 23 is provided. The outdoor fan 25 is rotationally driven by an outdoor fan motor 26. The outdoor expansion valve 24 is a valve that decompresses the flammable refrigerant circulating in the refrigerant circuit 20 during the heat pump heating operation, before sending to the outdoor heat exchanger 23. The four-way switching valve 29 is a valve that switches a flow direction of the flammable refrigerant in the refrigerant circuit 20. During the heat pump heating operation, the four-way switching valve 29 is switched to a heating state (see a broken line of the four-way switching valve 29 in FIG. 2) for causing the indoor heat exchanger 42 to function as a radiator for the flammable refrigerant, and causing the outdoor heat exchanger 23 to function as an evaporator for the flammable refrigerant. In addition, the four-way switching valve 29 can also be switched to a cooling state (see a solid line of the four-way switching valve 29 in FIG. 2) for causing the indoor heat exchanger 42 to function as an evaporator for the flammable refrigerant, and causing the outdoor heat exchanger 23 to function as a radiator for the flammable refrigerant.

Further, the outdoor unit 2 is provided with an outdoor temperature sensor 27 that detects a temperature of outdoor air outside of the house 100 where the outdoor unit 2 is arranged, that is, an outside air temperature Ta. Further, the outdoor unit 2 has an outdoor-side control unit 28 that controls an operation of each part constituting the outdoor unit 2. The outdoor-side control unit 28 has a microcomputer, a memory, and the like provided for controlling the outdoor unit 2, and can exchange control signals and the like with the utilization unit 3.

<Separate Heat Source Unit>

As described above, the separate heat source unit 70 is configured by the furnace unit 5, which is a part of the utilization unit 3.

Here, the furnace unit 5 is provided in the housing 30 of the utilization unit 3 installed in the basement 105 of the house 100. Here, the furnace unit 5 is a gas combustion heating device.

The furnace unit 5 mainly includes a fuel gas valve 51, a furnace fan 52, a combustion unit 54, a furnace heat exchanger 55, an air supply pipe 56, an exhaust pipe 57, and an ignition device 59. The fuel gas valve 51 is configured by an electromagnetic valve or the like controllable to open and close, and is provided in a fuel gas supply pipe 58 extending from outside of the housing 30 to the combustion unit 54. Here, as the fuel gas, natural gas, petroleum gas, or the like is used. The furnace fan 52 is a fan that generates an air flow of taking in air into the combustion unit 54 through the air supply pipe 55, then sending the air to the furnace heat exchanger 55, and discharging from the exhaust pipe 57. The furnace fan 52 is rotationally driven by a furnace fan motor 53. The combustion unit 54 is a device that obtains high-temperature combustion gas by burning mixed gas of fuel gas and air with a gas burner or the like (not illustrated). The ignition device 59 is provided in the combustion unit 54. The ignition device 59 includes an igniter, and ignites the combustion unit 54. Here, the combustion unit 54 is separated from the air-blowing flow path 30*a* by a wall, but a flammable refrigerant leaking from the indoor heat exchanger 42 may come into contact with the ignition device 59 if a hole is made on the wall. In order to reduce a possibility of ignition of the flammable refrigerant even in such a case, energy of the ignition device 59 is preferably 120 V or less. The furnace heat exchanger 55 is a heat exchanger that heats air by heat radiation from the combustion gas (that is, the separate heat source) obtained by the combustion unit 54. Here, the furnace heat exchanger 55 is arranged on a windward side of the indoor heat exchanger 42 (on an upstream side of the indoor heat exchanger 42 with respect to a flow direction of the air in the air-blowing flow path 30*a*), in the air-blowing flow path 30*a* from the air inflow port 32 to the air outflow port 31 formed in the housing 30 of the utilization unit 3. In addition, the utilization unit 3 is provided with a refrigerant sensor 33 that detects a flammable refrigerant, and an indoor temperature sensor 34 that detects an indoor temperature Tr, which is a temperature of air at the air inflow port 32 of the housing 30. Here, the refrigerant sensor 33 is provided on a downstream side of the indoor heat exchanger 42 with respect to a flow direction of air in the air-blowing flow path 30*a*. Further, the indoor temperature sensor 34 may be provided in the rooms 101 to 104 instead of the utilization unit 3.

<Indoor Fan>

As described above, the indoor fan 40 is a fan that sends, into the rooms 101 to 104, air heated by the indoor heat exchanger 42 constituting the heat pump unit 60 and the furnace heat exchanger 55 constituting the separate heat source unit 70. Here, in the air-blowing flow path 30*a* from the air inflow port 32 to the air outflow port 31 formed in the housing 30 of the utilization unit 3, the indoor fan 40 is arranged on a windward side of both the indoor heat exchanger 42 and the furnace heat exchanger 55 (on an upstream side of the indoor heat exchanger 42 and the furnace heat exchanger 55 with respect to a flow direction of the air in the air-blowing flow path 30*a*). The indoor fan 40 includes an indoor fan 43 and an indoor fan motor 44 that rotationally drives the indoor fan 43. As the indoor fan 43, a sirocco fan or a turbo fan is used.

<Control Unit>

The utilization unit 3 has a utilization-side control unit 38 that controls an operation of each unit (the indoor unit 4, the furnace unit 5, and the indoor fan 40) that constitutes the utilization unit 3. The utilization-side control unit 38 has a microcomputer, a memory, and the like provided for controlling the utilization unit 3, and can exchange control signals and the like with the outdoor unit 2.

Figure 3:
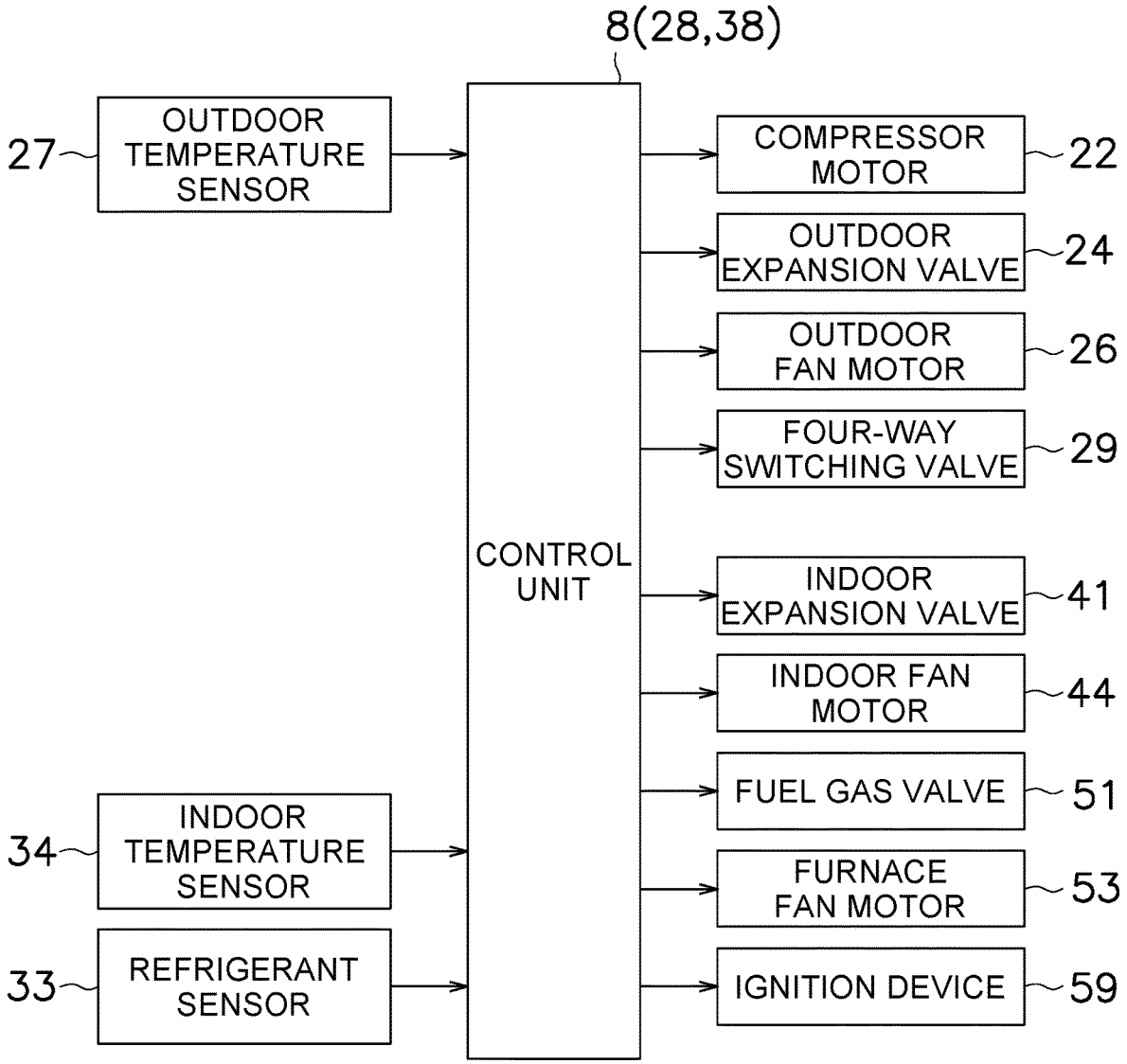
FIG. 3 is a control block diagram of the air conditioning system.

Then, as shown in FIG. 2, the utilization-side control unit 38 of the utilization unit 3 and the outdoor-side control unit 28 of the outdoor unit 2 constitute a control unit 8 that controls operation of the entire air conditioning system 1. As shown in FIG. 3, the control unit 8 is connected so as to be able to receive detection signals of various sensors 27, 33, and 34, and the like. Here, FIG. 3 is a control block diagram of the air conditioning system 1. Then, the control unit 8 is configured to perform an air conditioning operation (a heating operation) by controlling various devices and valves 22, 24, 26, 29, 41, 44, 51, 53, and 59 on the basis of these detection signals and the like, that is, by controlling an operation of the heat pump unit 60 and the separate heat source unit 70. Here, the control unit 8 performs the heat pump heating operation that heats the rooms 101 to 104 with the heat pump unit 60, and the separate heat source heating operation that heats the rooms 101 to 104 with the separate heat source unit 70.

(2) Operation

Next, an operation of the air conditioning operation (the heating operation) of the air conditioning system 1 will be described with reference to FIGS. 1 to 3. As described above, the heating operation of the air conditioning system 1 includes the heat pump heating operation for heating a room with the heat pump unit 60, and the separate heat source heating operation for heating a room with the separate heat source unit 70. Then, the heat pump heating operation and the separate heat source heating operation are performed by the control unit 8.

<Heat Pump Heating Operation>

In the heat pump heating operation, a flammable refrigerant in the refrigerant circuit is suctioned into the compressor 21, and compressed to become a high-pressure gas state. The flammable refrigerant compressed in the compressor 21 is sent from the outdoor unit 2 to the indoor unit 4 of the utilization unit 3, via the four-way switching valve 29 in a heating state and the gas-refrigerant connection pipe 7.

The high-pressure flammable refrigerant sent to the indoor unit 4 of the utilization unit 3 is sent to the indoor heat exchanger 42. In the indoor heat exchanger 42, the high-pressure flammable refrigerant sent to the indoor heat exchanger 42 exchanges heat by the indoor fan 40 with indoor air F1 (F2) flowing in the air-blowing flow path 30*a*, to radiate heat. The flammable refrigerant with heat radiated in the indoor heat exchanger 42 is decompressed by the indoor expansion valve 41, and then sent from the indoor unit 4 of the utilization unit 3 to the outdoor unit 2 via the liquid-refrigerant connection pipe 6. Whereas, indoor air F3 heated in the indoor heat exchanger 42 exits the air-blowing flow path 30*a*, and is sent from the utilization unit 3 to the individual rooms 101 to 104 through the duct 9, for heating.

The high-pressure flammable refrigerant sent to the outdoor unit 2 is sent to the outdoor expansion valve 24, and decompressed by the outdoor expansion valve 24. The flammable refrigerant decompressed in the indoor expansion valve 24 is sent to the outdoor heat exchanger 23. The flammable refrigerant sent to the outdoor heat exchanger 23 exchanges heat with outdoor air supplied with the outdoor fan 25, to be evaporated in the outdoor heat exchanger 23. The flammable refrigerant evaporated in the outdoor heat exchanger 23 is sent to the compressor 21 via the four-way switching valve 29 in the heating state, and is suctioned into the compressor 21 again.

<Separate Heat Source Heating Operation>

In the separate heat source heating operation, high-temperature combustion gas is generated by opening the fuel gas valve 51 to supply fuel gas to the combustion unit 54, mixing with air taken into the furnace unit 5 of the utilization unit 3 via the air supply pipe 56 by the furnace fan 52 in the combustion unit 54, and igniting by the ignition device 59 to burn.

The combustion gas generated in the combustion unit 54 is sent to the furnace heat exchanger 55. The combustion gas sent to the furnace heat exchanger 55 is cooled by heat exchange by the indoor fan 40 with the indoor air F1 flowing in the air-blowing flow path 30*a*, in the furnace heat exchanger 55. The combustion gas cooled in the furnace heat exchanger 55 is discharged from the furnace unit 5 of the utilization unit 3 via the exhaust pipe 57. Whereas, the indoor air F2 (F3) heated in the furnace heat exchanger 55 exits the air-blowing flow path 30*a*, and is sent from the utilization unit 3 to the individual rooms 101 to 104 through the duct 9, for heating.

<Selection of Heat Pump Heating Operation and Separate Heat Source Heating Operation>

In the air conditioning system 1, the control unit 8 performs the heat pump heating operation when a condition suitable for the heat pump heating operation (a heat pump heating condition) is satisfied, and performs the separate heat source heating operation when a condition suitable for the separate heat source heating operation (a separate heat source heating condition) is satisfied. Here, the control unit 8 determines whether the heat pump heating condition or the separate heat source heating condition is satisfied, on the basis of an outside air temperature Ta or an indoor load (for example, an indoor temperature difference ΔTr obtained by subtracting an indoor temperature Tr from a target indoor temperature Trt). For example, the control unit 8 performs the heat pump heating operation when the outside air temperature Ta is high (when the outside air temperature is equal to or more than a threshold outside air temperature Tat), or when the indoor load is small (when the indoor temperature difference ΔTr is less than or equal to a threshold indoor temperature difference ΔTr). On the contrary, the control unit 8 performs the separate heat source heating operation when the outside air temperature Ta is low (when the outside air temperature is less than the threshold outside air temperature Tat), or when the indoor load is large (when the indoor temperature difference ΔTr is larger than the threshold indoor temperature difference ΔTr). That is, the heat pump heating operation is performed when it is possible to cover an air conditioning load (a heating load) in the room by the heat pump heating operation with good operating efficiency, such as when the outside air temperature Ta is high or the indoor load is small, while the separate heat source heating operation is performed when the operation efficiency is poor and the air conditioning load (the heating load) in the room cannot be covered by the heat pump heating operation, such as when the outside air temperature Ta is low or the indoor load is large.

However, if the flammable refrigerant leaks from the refrigerant circuit 20, it becomes necessary to limit the use of the heat pump unit 60, which disables the heat pump heating operation. Then, if the flammable refrigerant is leaking even though the heat pump heating condition is satisfied, the heating itself of the room may not be performed, and comfort of a person in the room may be impaired.

Figure 4:
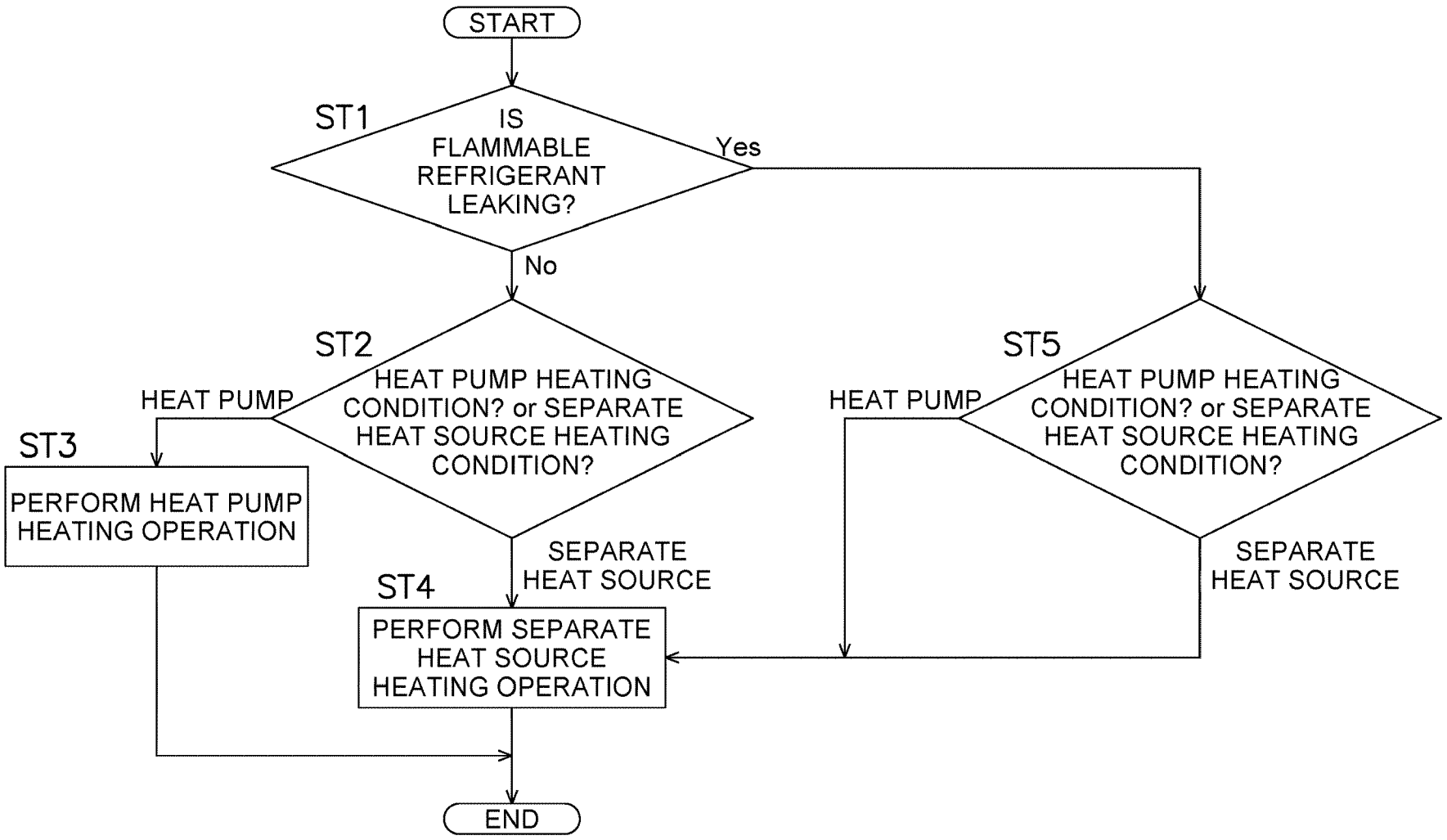
FIG. 4 is a flowchart showing an operation of the air conditioning system.

Therefore, here, as shown in FIG. 4, the heat pump heating operation and the separate heat source heating operation are selected and performed not only based on whether or not the heat pump heating condition or the separate heat source heating condition is satisfied, but also based on whether or not the flammable refrigerant is leaking from the refrigerant circuit 20. Here, FIG. 4 is a flowchart showing an operation of the air conditioning system 1. Then, the control unit 8 also selects the heat pump heating operation and the separate heat source heating operation.

When a command is given to the control unit 8 to perform the heating operation, first, in step ST1, the control unit 8 determines whether or not a flammable refrigerant is leaking from the refrigerant circuit 20. Here, the control unit 8 determines that the flammable refrigerant is leaking when the refrigerant sensor 33 detects the flammable refrigerant, and determines that the flammable refrigerant is not leaking when the refrigerant sensor 33 does not detect the flammable refrigerant. Then, in step ST1, the control unit 8 shifts to a process of step ST2 when the flammable refrigerant is not leaking, and shifts to a process of step ST5 when the flammable refrigerant is leaking.

Next, in step ST2, the control unit 8 determines whether the heat pump heating condition or the separate heat source heating condition is satisfied. Here, the control unit 8 determines whether the heat pump heating condition or the separate heat source heating condition is satisfied, on the basis of the outside air temperature Ta or the indoor load (here, the indoor temperature difference ΔTr). Specifically, the control unit 8 determines that the heat pump heating condition is satisfied when the outside air temperature Ta is equal to or more than the threshold outside air temperature Tat, or when the indoor temperature difference ΔTr is less than or equal to the threshold indoor temperature difference ΔTr, and determines that the separate heat source heating condition is satisfied when the outside air temperature Ta is less than the threshold outside air temperature Tat, or when the indoor temperature difference ΔTr is larger than the threshold indoor temperature difference ΔTr. Then, in step ST2, the control unit 8 shifts to the process of step ST3 when the heat pump heating condition is satisfied, and shifts to the process of step ST4 when the separate heat source heating condition is satisfied.

Next, when it is determined in step ST2 that the heat pump heating condition is satisfied, in step ST3, the control unit 8 performs the heat pump heating operation described above. Further, when it is determined in step ST2 that the separate heat source heating condition is satisfied, in step ST4, the control unit 8 performs the separate heat source heating operation described above. In this way, here, when a flammable refrigerant is not leaking, the control unit 8 heats a room with the heat pump unit 60 when the heat pump heating condition is satisfied, and heats the room with the separate heat source unit 70 when the separate heat source heating condition is satisfied.

Whereas, even when it is determined in step ST1 that the flammable refrigerant is leaking, in step ST5, similarly to step ST2, the control unit 8 determines whether the heat pump heating condition or the separate heat source heating condition is satisfied. However, if the flammable refrigerant is leaking, it becomes necessary to limit the use of the heat pump unit 60. Therefore, unlike a case where the flammable refrigerant is not leaking, the separate heat source heating operation is performed in step ST4 in both cases where the heat pump heating condition is satisfied and where the separate heat source heating condition is satisfied. In this way, here, when the flammable refrigerant is leaking, the control unit 8 heats the room with the separate heat source unit in both cases where the heat pump heating condition is satisfied and where the separate heat source heating condition is satisfied. Note that, when the flammable refrigerant is leaking, the separate heat source heating operation is performed in both cases where the heat pump heating condition is satisfied and where the separate heat source heating condition is satisfied. Therefore, the determination process in step ST5 may be omitted, and the process may be shifted from step ST1 to step ST4.

(3) Characteristics

Next, characteristics of the air conditioning system 1 will be described.

<A>

Here, as described above, in the air conditioning system 1 having: the heat pump unit 60 that heats a room with the refrigerant circuit 20 of vapor compression; and the separate heat source unit 70 that heats the room with the heat source separate from the heat pump unit 60, when the flammable refrigerant is not leaking, the control unit 8 heats the room with the heat pump unit in a case where the heat pump heating condition is satisfied, and heats the room with the separate heat source unit in a case where the separate heat source heating condition is satisfied. In addition, when the flammable refrigerant is leaking, the control unit 8 heats the room with the separate heat source unit in both cases where the heat pump heating condition is satisfied and where the separate heat source heating condition is satisfied.

As a result, here, when the flammable refrigerant is leaking, the room is heated by the separate heat source unit 70 even if the heat pump heating condition is satisfied. Therefore, it is possible to avoid a case where the heating itself of the room is inhibited, and prevent impairment of comfort of a person in the room.

<B>

Further, here, as described above, the control unit 8 determines whether the heat pump heating condition or the separate heat source heating condition is satisfied, on the basis of the outside air temperature Ta or the indoor load. Note that whether the heat pump heating condition or the separate heat source heating condition is satisfied may be determined using not only the outside air temperature Ta or the indoor load, but also other state quantities. That is, at least the outside air temperature Ta or the indoor load is used to determine whether the heat pump heating condition or the separate heat source heating condition is satisfied.

This allows, here, the room to be heated by the separate heat source unit 70, even if the outside air temperature Ta or the indoor load satisfies the heat pump heating condition, when the flammable refrigerant is leaking.

<C>

Further, here, as described above, the separate heat source unit 70 has the furnace unit 5 (the furnace) that heats air to be sent into the room by burning the fuel.

This allows, here, the room to be heated by the furnace 5 in a case where the separate heat source heating condition is satisfied, when the flammable refrigerant is not leaking, and the room to be heated by the furnace 5 in both cases where the heat pump heating condition is satisfied and where the separate heat source heating condition is satisfied, when flammable refrigerant is leaking.

<D>

Further, here, as described above, the refrigerant sensor 33 that detects a flammable refrigerant is provided.

This enables, here, the refrigerant sensor 33 to be used to detect whether or not a flammable refrigerant is leaking.

Further, here, since the refrigerant sensor 33 is arranged in the air-blowing flow path 30*a*, it is possible to quickly detect whether or not the flammable refrigerant is leaking.

(4) Modified Examples

<A>

In the embodiment described above, in the utilization unit 3, the furnace heat exchanger 55 of the furnace unit 5 constituting the separate heat source unit 70 is arranged on a windward side of the indoor heat exchanger 42 of the indoor unit 4 constituting the heat pump unit 60 (on an upstream side of the indoor heat exchanger 42 with respect to a flow direction of air in the air-blowing flow path 30*a*). However, the arrangement of both the heat exchangers 42 and 55 is not limited to this.

Figure 5:
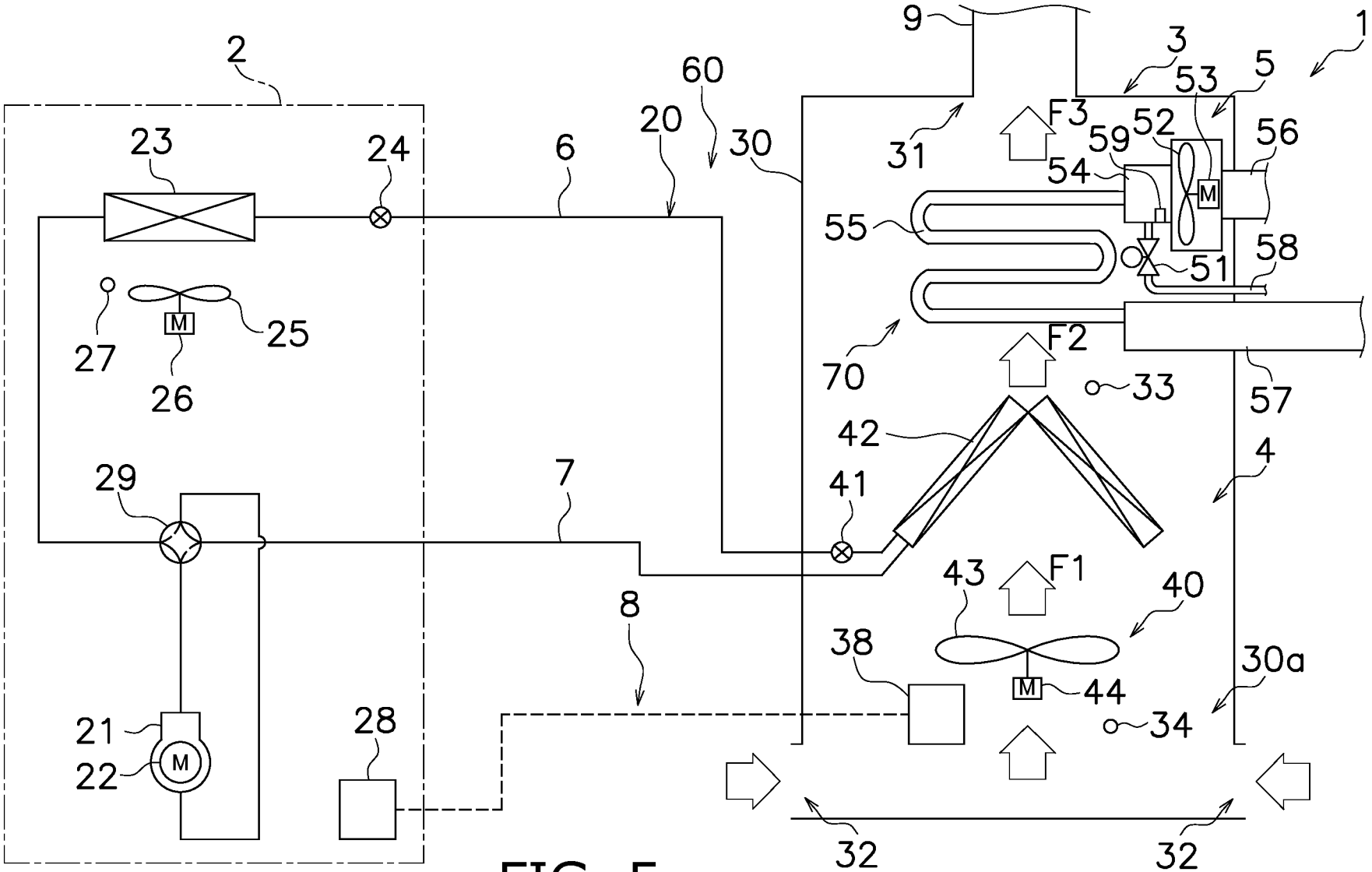
FIG. 5 is a schematic configuration diagram of an air conditioning system according to Modified example A.

For example, as shown in FIG. 5, the furnace heat exchanger 55 of the furnace unit 5 as the separate heat source unit 70 may be arranged on a leeward side of the indoor heat exchanger 42 of the indoor unit 4 as the heat pump unit 60 (on a downstream side of the indoor heat exchanger 42 with respect to a flow direction of the air in the air-blowing flow path 30*a*). Here, the refrigerant sensor 33 is provided on a downstream side of the indoor heat exchanger 42 and on an upstream side of the furnace indoor heat exchanger 42 with respect to a flow direction of the air in the air-blowing flow path 30*a*.

<B>

In the embodiment and Modified example A described above, the furnace unit 5 constitutes the separate heat source unit 70, but the separate heat source unit 70 is not limited to this.

Figure 6:
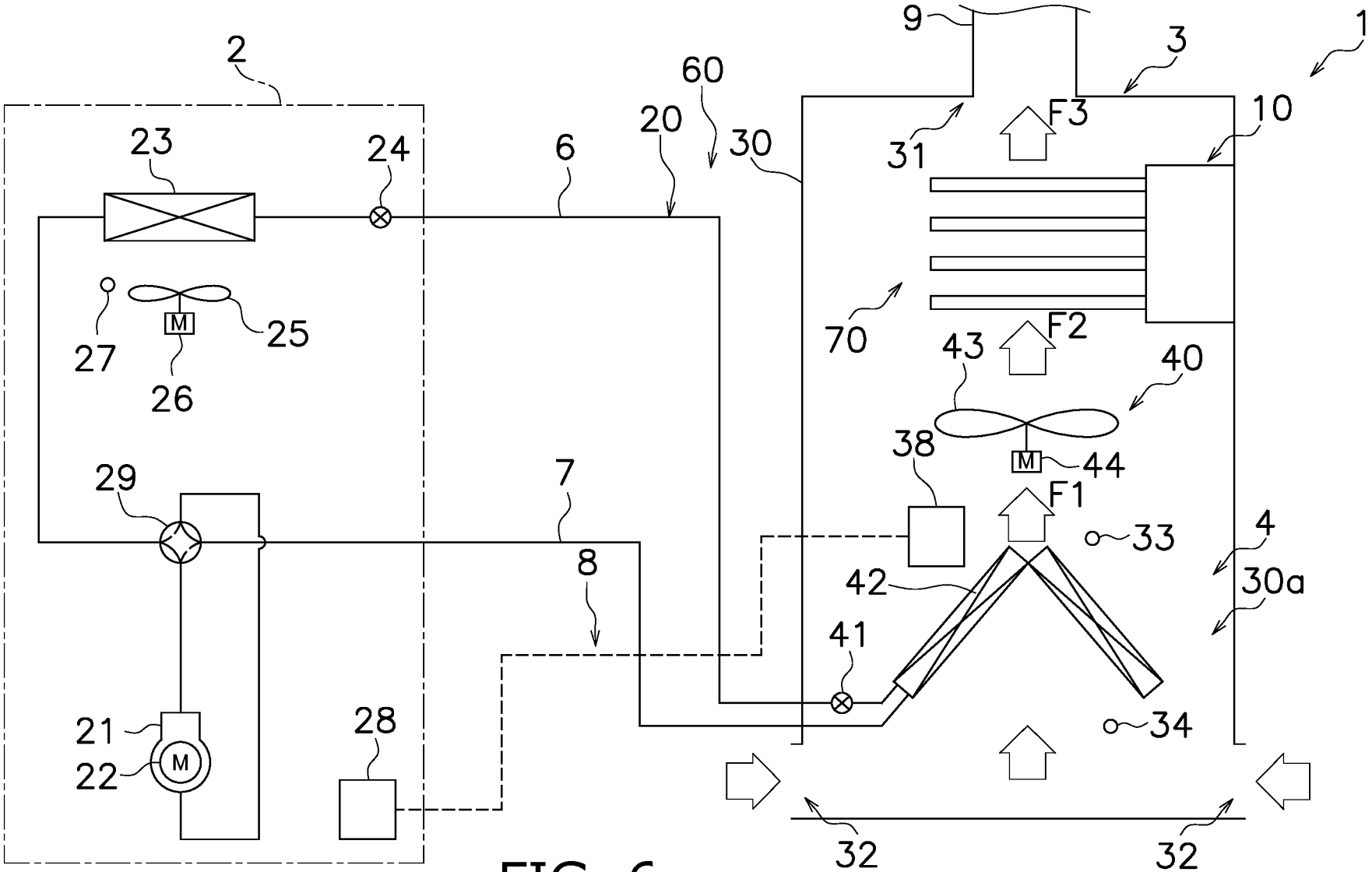
FIG. 6 is a schematic configuration diagram of an air conditioning system according to Modified example B.
Figure 7:
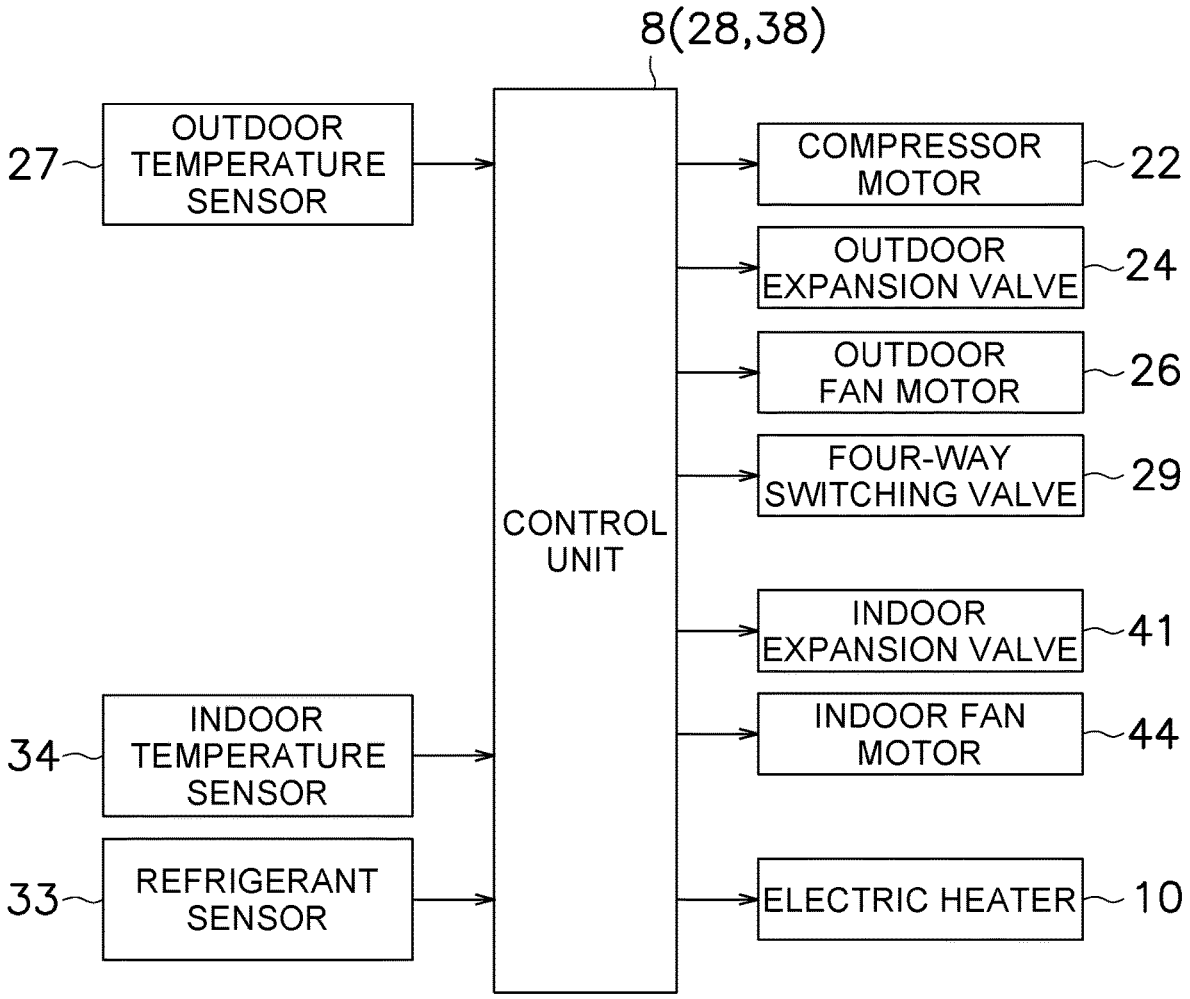
FIG. 7 is a control block diagram of the air conditioning system according to Modified example B.

For example, as shown in FIGS. 6 and 7, an electric heater 10 that heats air with heat generated by energization may constitute the separate heat source unit 70. Here, in order to reduce the possibility of ignition of the flammable refrigerant even if the flammable refrigerant leaking from the indoor heat exchanger 42 comes into contact with the electric heater 10, energy of the electric heater 10 is preferably 25 kW or less. Here, in the air-blowing flow path 30*a* from the air inflow port 32 to the air outflow port 31 formed in the housing 30 of the utilization unit 3, the indoor heat exchanger 42 of the indoor unit 4 constituting the heat pump unit 60, the indoor fan 40, and the electric heater 10 constituting the separate heat source unit 70 are provided sequentially from a windward side to a leeward side. Here, the refrigerant sensor 33 is provided on a downstream side of the indoor heat exchanger 42 and on an upstream side of the electric heater 10 with respect to a flow direction of the air in the air-blowing flow path 30*a*.

<C>

In the embodiment and Modified examples A and B described above, the air-blowing flow path 30*a* is formed so that air flows upward from the air inflow port 32 toward the air outflow port 31, but the present invention is not limited to this. For example, although not illustrated here, the air-blowing flow path 30*a* may be formed so that air flows downward from the air inflow port 32 toward the air outflow port 31, and may be formed so that air flows horizontally. In this case, along the flow directions of the air, the indoor fan 40, the indoor heat exchanger 42 constituting the heat pump unit 60, the furnace heat exchanger 55 constituting the separate heat source unit 70, and the electric heater 10 are provided.

<D>

In the embodiment and Modified examples A to C described above, whether or not the flammable refrigerant is leaking is detected by using the refrigerant sensor 33, but may be, without limiting to this, detected using a temperature, a pressure, or the like of the flammable refrigerant in the refrigerant circuit 20.

<E>

In the embodiment and Modified examples A to D, the room is heated by the refrigerant circuit 20 constituting the heat pump unit 60 (the heat pump heating operation). However, in addition to this operation, the room can also be cooled by the refrigerant circuit constituting the heat pump unit 60, by switching the four-way switching valve 29 to a cooling state.

<F>

In the embodiment and Modified examples A to E described above, a refrigerant sensor may be further arranged near the indoor fan 40. For example, when a sirocco fan is used as the indoor fan 40, the refrigerant sensor may be arranged near a suction port. Arranging the refrigerant sensor at such a position enables quick detection of the presence or absence of leakage of the flammable refrigerant when the indoor fan 40 is rotated.

Although the embodiments of the present disclosure have been described above, it will be understood that various changes in forms and details can be made without departing from the gist and scope of the present disclosure as set forth in the claims.

INDUSTRIAL APPLICABILITY

The present disclosure can be widely applicable to an air conditioning system including a heat pump unit that heats a room with a vapor compression refrigerant circuit; and a separate heat source unit that heats the room with a heat source separate from the heat pump unit.

REFERENCE SIGNS LIST

1: air conditioning system
5: furnace unit (furnace)
8: control unit
20: refrigerant circuit
33: refrigerant sensor
60: heat pump unit
70: separate heat source unit

CITATION LIST

Patent Literature

Patent Literature 1: JP S64-54160 A

The invention claimed is:

1. An air conditioning system comprising:

a heat pump unit that heats a room with a refrigerant circuit of vapor compression;

a separate heat source that heats the room with a heat source separate from the heat pump unit, said separate heat source being a furnace that heats air to be sent into the room by burning fuel and being housed in an indoor unit and having an igniter, said refrigerant circuit extending into a space in the indoor unit occupied by said furnace such that a shared space of the indoor unit houses both said furnace and a portion of said refrigerant circuit; and a controller that controls an operation of the heat pump unit and the separate heat source, wherein a flammable refrigerant is sealed in the refrigerant circuit as a refrigerant, when the controller determines that the flammable refrigerant is not leaking in said shared space, the controller heats the room with the heat pump unit instead of the separate heat source in a case where a heat pump heating condition is satisfied, and heats the room with the furnace instead of the heat pump unit in a case where a separate heat source heating condition is satisfied, and when the controller determines that the flammable refrigerant is leaking in said shared space, the controller heats the room with the furnace instead of the heat pump unit where the heat pump heating condition is satisfied.

2. The air conditioning system according to claim 1, wherein the controller determines whether the heat pump heating condition or the separate heat source heating condition is satisfied, based on an outside air temperature or an indoor load.

3. The air conditioning system according to claim 1, further comprising:

a refrigerant sensor in the shared space that detects the flammable refrigerant.

4. The air conditioning system according to claim 2, further comprising:

a refrigerant sensor in the shared space that detects the flammable refrigerant.

* * * * *